US008955943B2

(12) United States Patent
Watanabe

(10) Patent No.: US 8,955,943 B2
(45) Date of Patent: Feb. 17, 2015

(54) LIQUID EJECTING HEAD AND LIQUID EJECTING APPARATUS

(71) Applicant: Seiko Epson Corporation, Tokyo (JP)

(72) Inventor: Shunsuke Watanabe, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/060,831

(22) Filed: Oct. 23, 2013

(65) Prior Publication Data

US 2014/0118437 A1 May 1, 2014

(30) Foreign Application Priority Data

Oct. 29, 2012 (JP) ..... 2012-237562

(51) Int. Cl.
*B41J 2/165* (2006.01)
*B41J 2/14* (2006.01)

(52) U.S. Cl.
CPC .... *B41J 2/14233* (2013.01); *B41J 2002/14362* (2013.01)
USPC ..... 347/22; 277/307; 285/235

(58) Field of Classification Search
CPC ..... B41J 2002/14306; B41J 2/165
USPC ..... 347/20, 22, 65; 277/307, 309, 311, 314, 277/315, 602, 608, 609, 616, 630, 637, 644, 277/650; 285/235, 236, 237
See application file for complete search history.

(56) References Cited

U.S. PATENT DOCUMENTS

2012/0182351 A1 7/2012 Watanabe
2012/0182363 A1 7/2012 Watanabe

FOREIGN PATENT DOCUMENTS

JP 11051289 A * 2/1999
JP 2003-039672 2/2003
JP 2003039672 A * 2/2003
JP 2012-148410 8/2012
JP 2012-148411 8/2012

OTHER PUBLICATIONS

Fernco Inc. drawing, dated Oct. 1, 2007sheet 1 of 1, D. Brady http://www.fernco.com/sites/default/files/dimensional-drawings/pdf/1002-1010.PDF (Jun. 5, 2014).*
http://web.archive.org/web/20121005051019/http://www.fluidmaster.com/toilet-replacement-seal.html ("Fluidmaster").*

* cited by examiner

*Primary Examiner* — Alessandro Amari
*Assistant Examiner* — Michael Konczal

(57) ABSTRACT

A seal member includes a communication hole that makes a holder flow path communicate with a connection flow path in a state of the seal member being nipped between a holder projection and a connection projection, a holder-side fitting recess that fits onto the outer circumferential surface of the holder projection and also fits to a leading end portion of the holder projection, a connection member-side fitting recess that fits onto the outer circumferential surface of the connection projection and also fits to a leading end portion of the connection projection, and a recessed groove that is hollowed in the bottom of the holder-side fitting recess or the bottom of the connection member-side fitting recess along the inner circumferential surface of the holder-side fitting recess or the connection member-side fitting recess.

6 Claims, 5 Drawing Sheets

LIQUID EJECTING HEAD AND LIQUID EJECTING APPARATUS

BACKGROUND

1. Technical Field

The present invention relates to a liquid ejecting head for ejecting liquid, through a nozzle, that has been introduced into a pressure chamber through a flow path provided inside the liquid ejecting head, and a liquid ejecting apparatus that includes the stated liquid ejecting head.

2. Related Art

Liquid ejecting apparatuses are an apparatus that includes a liquid ejecting head and ejects various types of liquids from the liquid ejecting head. As the liquid ejecting apparatuses, for example, image recording apparatuses such as an ink jet printer, an ink jet plotter, and the like can be cited. In addition, nowadays liquid ejecting apparatuses are also applied in various types of manufacturing apparatuses because the liquid ejecting apparatuses can precisely land a minute amount of liquid onto a predetermined position. For example, they are applied in display manufacturing apparatuses for the manufacture of color filters of liquid crystal displays or the like, electrode forming apparatuses for the formation of electrodes of organic EL (electroluminescence) displays, FEDs (surface emitting displays) or the like, and chip manufacturing apparatuses for the manufacture of biochips (biochemical elements). A recording head of an image recording apparatus ejects ink in liquid form, and a coloring material ejecting head of a display manufacturing apparatus ejects solutions of different coloring materials of R (red), G (green) and B (blue). Further, an electrode material ejecting head of an electrode forming apparatus ejects an electrode material in liquid form, and a bioorganic matter ejecting head of a chip manufacturing apparatus ejects a solution of bioorganic matter.

The liquid ejecting heads mentioned above are configured so that liquid is introduced into a pressure chamber from a cartridge in which the liquid is stored, a pressure change in the liquid inside the pressure chamber is generated, and then the liquid is ejected through a nozzle communicating with the pressure chamber. Such liquid ejecting head is structured of a plurality of laminated members, in which the cartridge communicates with the pressure chamber via a plurality of passages provided inside the laminated members. Note that a seal member made of an elastic material is used so as to make the passages in the laminated members communicate with each other in some case.

For example, JP-A-2003-39672 discloses a configuration in which a main head body having a head flow path to communicate with a nozzle and a head holder having a holder flow path formed therein to introduce ink from an ink cartridge to the head flow path are included, and in which the holder flow path and the head flow path are made to communicate with each other by a seal member disposed between the main head body and the head holder. To be more specific, the seal member is nipped and pressed down to deform between an opening edge of the head flow path and an opening edge of the holder flow path so that the head flow path and the holder flow path are made to communicate with each other via a communication port provided in the seal member.

However, in the liquid ejecting head described above, reactive force is produced in a portion of the seal member that is nipped and pressed down to deform and stress caused by the reactive force is transmitted to the members on the upper and lower sides of the seal member and also to other members, which raises a risk that the whole liquid ejecting head is deformed. If the liquid ejecting head is deformed, there is a risk that an ejection (discharge) failure occurs in which a landing position of a liquid droplet ejected through the nozzle is deviated from a desired position, or the like. Meanwhile, although it can be considered to reduce the reactive force by lessening the force of nipping and pressing down to deform the seal member, there is a risk that a sealing effect is lowered between the flow paths communicating with each other by the seal member. In the case where the seal member is not sufficiently nipped and pressed down to deform, an inner surface of the communication port of the seal member is not flush with an inner surface of the flow path so that a step is produced therebetween. If such step is produced, air bubbles stay at the step when liquid is injected, which raises a risk of the occurrence of the ejection failure.

SUMMARY

An advantage of some aspects of the invention is to provide a liquid ejecting head and a liquid ejecting apparatus in which two flow paths respectively provided in different members are made to communicate with each other by a seal member nipped between the different members and reactive force of the nipped seal member is reduced as well.

A liquid ejecting head according to the invention includes a first head constituent member equipped with a first flow path, a second head constituent member equipped with a second flow path, and a seal member that is disposed between the first and second head constituent members and makes the first flow path communicate with the second flow path, and these three members are laminated; and this liquid ejecting head ejects liquid that is introduced through the first and second flow paths. Further, in the liquid ejecting head, at least one of the first and second head constituent members includes a first projection that sticks out toward the seal member and provides an opening of the flow path of the one of the head constituent members in a leading end of the first projection. Furthermore, the seal member includes a communication hole that makes the first flow path communicate with the second flow path, a first recess that fits onto an outer circumferential surface of the first projection and also fits to a leading end portion of the first projection, and a second recess that is hollowed in the bottom of the first recess along an inner circumferential surface of the first recess.

According to this configuration, the second recess that is provided in the first recess allows deformation of the seal member at a communication portion between the first and second flow paths, whereby the reactive force of the seal member can be reduced. This makes it possible to suppress the liquid ejecting head from deforming itself due to the reactive force and consequently suppress the occurrence of a liquid droplet ejection (discharge) failure. In addition, because the position of the first projection can be regulated by the first recess, even if a seal member with a low coefficient of elasticity is used, the deviation in position is suppressed so that the first flow path and the second flow path can be made to surely communicate with each other. As a result, for example, a hyperelastic material such as rubber can be used as a seal member, thereby making it possible to further reduce the reactive force of the seal member.

In the above configuration, it is preferable that the seal member be formed of an elastic material.

According to this configuration, it is possible to reduce the reactive force of the seal member.

In the above-mentioned configurations, it is preferable that the first recess be formed at an inner side of a cylindrical portion which is erected from a face on the first projection side in a direction to the same side.

According to this configuration, an outer wall constructing the inner circumferential surface of the first recess can be made thinner to be bent with ease. This makes it easier to fit and connect the first recess to the leading end portion of the first projection.

Further, a liquid ejecting apparatus according to the invention includes the liquid ejecting head in each configuration described above.

According to this configuration, the reactive force of the seal member is reduced, and as a result the occurrence of the liquid droplet ejection (discharge) failure can be suppressed, thereby enhancing reliability of the apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments that embodies the invention will be described with reference to the drawings. It is to be noted that in the embodiments described below, although various kinds of limitations are given in the descriptions as preferred examples of the invention, the scope of the invention is not limited thereto unless any specific description that limits the invention is explicitly given. Further, in the following descriptions, an ink jet printer (hereinafter, called a printer) including an ink jet recording head (hereinafter, called a recording head), which is a type of liquid ejecting head, will be exemplified as a liquid ejecting apparatus of the invention.

Figure 1:
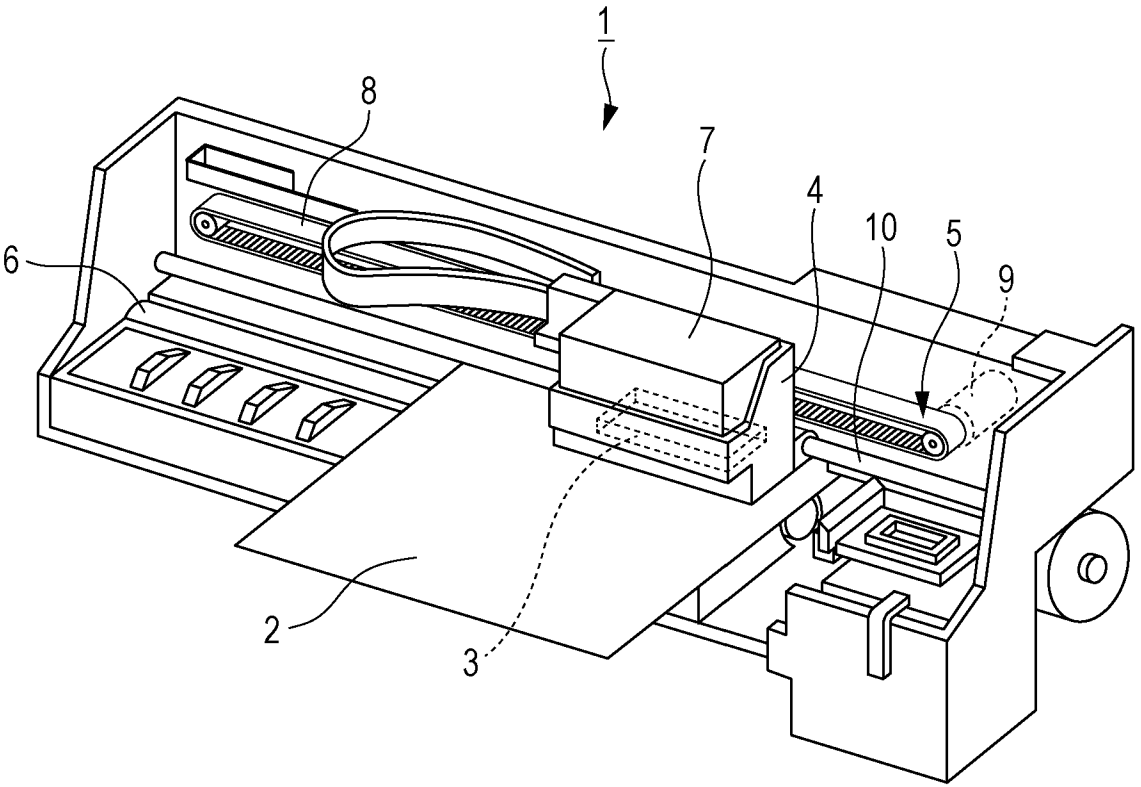
FIG. 1 is a descriptive perspective view illustrating the configuration of a printer.

The configuration of a printer 1 will be described with reference to FIG. 1. The printer 1 is an apparatus that records images or the like by ejecting ink in liquid form onto a surface of a recording medium 2 (a type of landing target) such as recording paper or the like. The printer 1 includes a recording head 3, a carriage 4 on which the recording head 3 is mounted, a carriage movement mechanism 5 that moves the carriage 4 in a main scanning direction, a transport mechanism 6 that moves the recording medium 2 in a sub scanning direction, and the like. Note that the above-mentioned ink is a type of liquid of this invention and is stored in an ink cartridge 7 as a liquid supply source. The ink cartridge 7 is attached to the recording head 3 (to a holder 14 to be described later) in a detachable manner. Meanwhile, it is also possible to employ a configuration in which the ink cartridge 7 is disposed at a main body side of the printer 1 and ink is supplied to the recording head 3 from the ink cartridge 7 through an ink supply tube.

The carriage movement mechanism 5 is provided with a timing belt 8. The timing belt 8 is driven by a pulse motor 9 such as a DC motor or the like. Accordingly, when the pulse motor 9 operates, the carriage 4 moves back and forth in the main scanning direction (width direction of the recording medium 2) being guided by a guide rod 10 installed in the printer 1.

Figure 2:
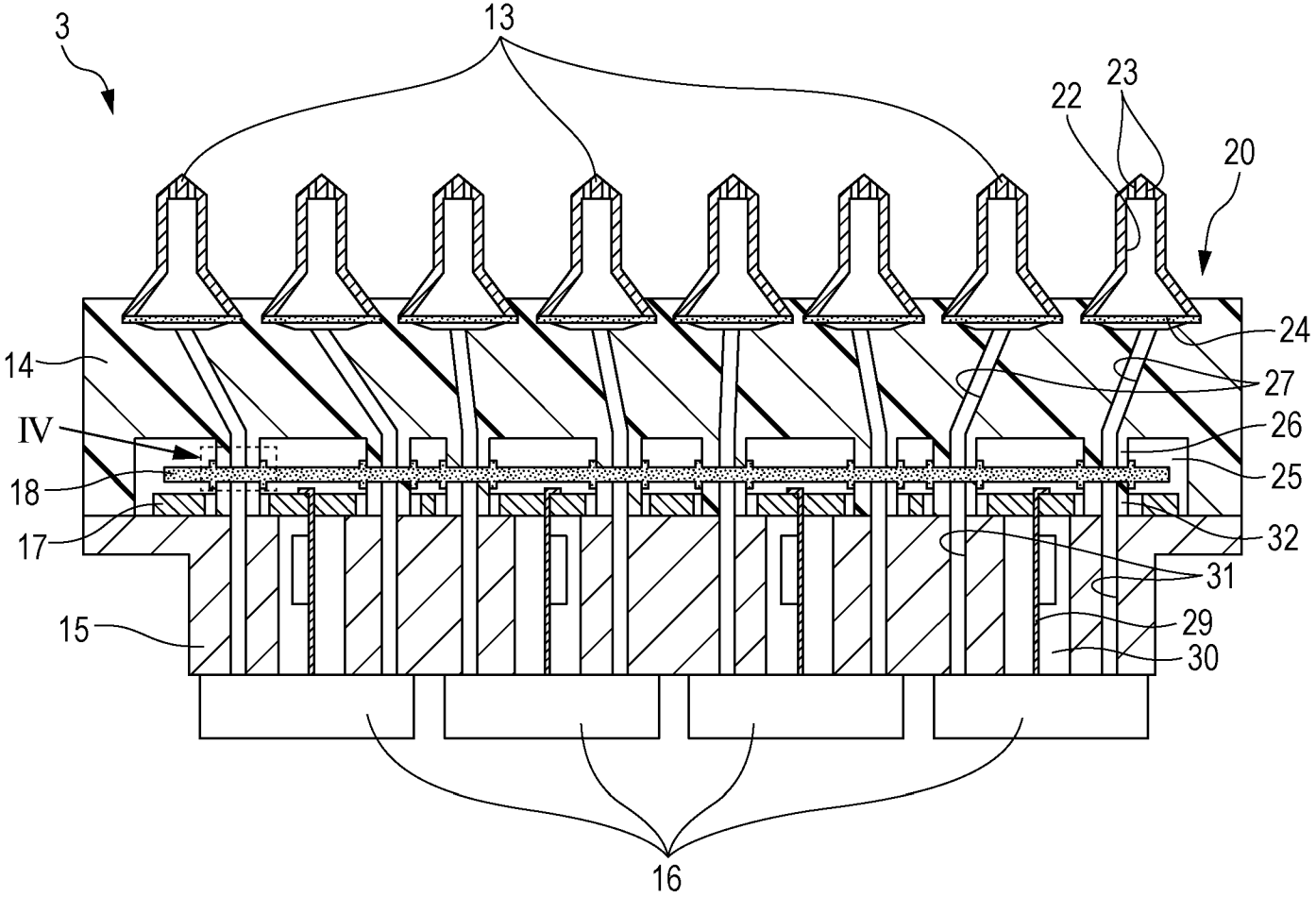
FIG. 2 is a cross-sectional view illustrating a recording head.

The recording head 3 of this embodiment includes, as shown in FIG. 2, ink introduction needles 13, a holder 14 (equivalent to a first head constituent member of this invention), a connection member 15 (equivalent to a second head constituent member of this invention), recording head main bodies 16 (a type of liquid ejecting head main body), a connection substrate 17, a seal member 18, and so on. In this embodiment, four recording head main bodies 16 are arranged being spaced from each other on a lower surface of the connection member 15.

The holder 14 is a member that is formed of resin or the like and is attached to an upper surface side of the connection member 15 (opposite side to the recording head main body 16). On the upper surface of the holder 14, there is provided a cartridge attachment unit 20 to which the ink cartridge 7 is attached in a detachable manner. In the upper surface of the cartridge attachment unit 20, a plurality of ink introduction needles 13 are erected. The ink introduction needles 13 are a member that has an introduction needle flow path 22 formed therein and introduces ink from the ink cartridge 7. Further, in a tip portion of the ink introduction needle 13, there are provided a plurality of introduction holes 23 configured to make the exterior of the ink introduction needle 13 communicate with the introduction needle flow path 22. With this, it is possible to introduce ink from the ink cartridge 7 attached to the cartridge attachment unit 20 to the introduction needle flow path 22 via the introduction holes 23. In this embodiment, eight ink introduction needles 13 are aligned straight in line. Note that this invention can be also applied in a configuration where the ink cartridge 7 is disposed at the main body side of the printer 1 and ink is introduced to the recording head 3 side from the ink cartridge 7 through a supply tube.

Meanwhile, in this embodiment, on a lower surface side of the holder 14 (connection member 15 side), there is provided an accommodation space 25 that is recessed from the lower surface thereof halfway to the opposite side and that can accommodate the connection substrate 17 and the seal member 18. Inside the holder 14, there is provided a holder flow path 27 (equivalent to a first flow path of this invention) whose upper end communicates with the introduction needle flow path 22 via a filter 24 configured to filtrate ink and whose lower end is open to the inside of the accommodation space 25. On a bottom surface inside the accommodation space 25 (surface opposed to the connection member 15), there is provided a holder projection 26 (equivalent to a first projection of this invention) sticking out toward the connection member 15 side. The lower end of the holder flow path 27 is open in the leading end (lower end) of the holder projection 26. Note that in this embodiment, eight holder flow paths 27 as well as eight holder projections 26 are provided corresponding to the eight ink introduction needles 13. The holder projection 26 of this embodiment is formed in a cylindrical shape. Of the lower surface of the holder 14, an opening edge of the accommodation space 25 is connected and fixed to the connection member 15 using screws or the like.

The holder 14 is connected to the upper surface side of the connection member 15, while the recording head main bodies 16 are connected to the lower surface side of the connection member 15. Inside the connection member 15, there are provided a connection space 30 into which a flexible cable 29 is inserted and a connection flow path 31 (equivalent to a second flow path of this invention) which introduces liquid from the holder 14 to the recording head main body 16; the connection space 30 and connection flow path 31 are formed penetrating through in a plate thickness direction of the connection member 15. In this embodiment, four connection spaces 30 are provided corresponding to the four recording head main bodies 16. Further, eight connection flow paths 31 are provided corresponding to the eight holder flow paths 27. On the upper surface of the connection member 15, there is provided a connection projection 32 (equivalent to a first projection of this invention) sticking out toward the holder 14 side. The upper end of the connection flow path 31 is open in the leading end of the connection projection 32. In this embodiment, the connection projection 32 is formed in a cylindrical shape whose diameter is smaller than that of the holder projection 26 (see FIG. 4).

The connection substrate 17 is a type of circuit board with which one end of the flexible cable 29 is connected; via the flexible cable 29, an electric signal from a control unit (not shown) is sent to a piezoelectric element 40, which will be described later. In this embodiment, the connection substrate 17 is accommodated in the accommodation space 25 in a state of being mounted on the upper surface of the connection member 15. Further, an opening (not shown) through which the connection projection 32 of the connection member 15 is inserted is provided in the connection substrate 17 corresponding to each of the connection projections 32. Accordingly, each of the connection projections 32 sticks out upward (to the inside of the accommodation space 25) through the opening of the connection substrate 17 in the state of the connection substrate 17 being mounted on the upper surface of the connection member 15.

The seal member 18 formed in a plate (sheet) shape having a uniform thickness is disposed above the connection substrate 17. More specifically, the seal member 18 is an elastic member having flexibility that is disposed (nipped) between the holder projection 26 of the holder 14 and the connection projection 32 of the connection member 15, and makes the holder flow path 27 communicate with the connection flow path 31. The seal member 18 of this embodiment is formed of, for example, a hyperelastic material such as rubber or the like. The structure of a section of the seal member 18 configured to connect the holder flow path 27 with the connection flow path 31 will be described later in detail.

Next, the recording head main body 16 will be described.

Figure 3:
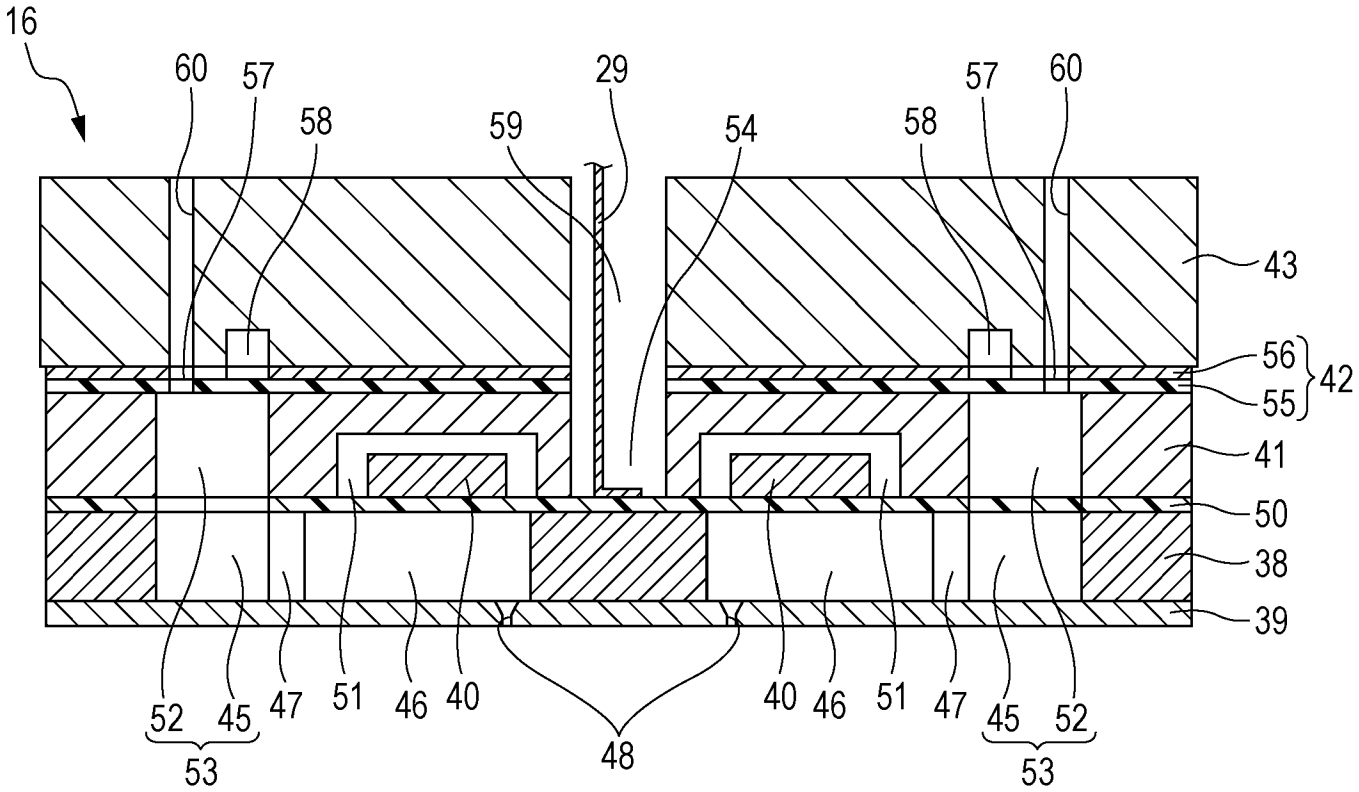
FIG. 3 is a cross-sectional view illustrating a recording head main body.

As shown in FIG. 3, the recording head main body 16 includes a flow path substrate 38, a nozzle plate 39, the piezoelectric element 40 (a type of pressure generation device), a protection substrate 41, a compliance substrate 42, and a head case 43.

The flow path substrate 38 is formed of a single-crystal silicon substrate elongated along a nozzle row direction, and two elongate communication sections 45 are formed along the nozzle row direction. In a region sandwiched by these communication sections 45, a plurality of pressure chambers 46 are formed being arranged in the nozzle row direction. In this embodiment, the pressure chambers 46 corresponding to each of the communication sections 45 are formed in two rows. Each of the pressure chambers 46 communicates with the communication section 45 via an ink supply path 47, which is formed having a narrower width than that of the pressure chamber 46.

The nozzle plate 39 is fixedly bonded to a lower surface of the flow path substrate 38 (surface on the opposite side to the piezoelectric element 40) via an adhesive, a thermal welding film, or the like. The nozzle plate 39 is formed of stainless steel (SUS), a single-crystal silicon, or the like, and a plurality of nozzles 48 are provided penetrating therethrough; each nozzle 48 communicates with each pressure chamber 46 at a position opposite to the ink supply path 47 of the each pressure chamber 46. These nozzles 48 configure a nozzle row which is aligned at a pitch of, for example, 360 dpi.

An elastic film 50 is laminated on an upper surface of the flow path substrate 38 (surface on the opposite side to the nozzle plate 39). On the elastic film 50, the piezoelectric elements 40 are arranged in two rows facing the pressure chambers 46; on each of the piezoelectric elements 40, a lower electrode film, a piezoelectric layer, and an upper electrode film are laminated in that order. One end of a leading electrode (not shown) configured to have a conductive connection with the upper electrode film is connected to an end portion at one side (center side) of the piezoelectric element 40. The other end of the leading electrode extends on an insulator film to a central portion side of the main head body to be electrically connected with the other end of the flexible cable 29.

Furthermore, the protection substrate 41 having piezoelectric element holding spaces 51 therein is bonded onto the elastic film 50; each of the piezoelectric element holding spaces 51 is provided in a region opposed to the piezoelectric element 40 and is so sized as not to interfere with the displacement of the piezoelectric element 40. In the protection substrate 41, two long liquid chamber spaces 52 are provided penetrating therethrough in the thickness direction at the positions opposed to the communication sections 45, and also provided is an arrangement space 54 at a central portion thereof where the flexible cable 29 can be connected with the leading electrode. The arrangement space 54 is formed at a position corresponding to an insertion space 59 of the head case 43 and communicates with the insertion space 59. Each of the liquid chamber spaces 52 communicates with each of the communication sections 45 to construct reservoirs 53 (common liquid chambers) for supplying ink to the pressure chambers 46.

The compliance substrate 42 is a substrate in which a flexible sealing film 55 and a fixing substrate 56 made of a hard material such as metal or the like are laminated, and is bonded to the upper side of the protection substrate 41 (opposite side to the flow path substrate 38). In the compliance substrate 42, ink introduction ports 57 are formed penetrating therethrough in the thickness direction so as to introduce ink to the reservoirs 53. Of the area of the compliance substrate 42 opposed to the reservoirs 53, portions in the area other than the ink introduction ports 57 are configured to be sealing sections 58 formed of only the sealing film 55 by removing the fixing substrate 56. With this, the reservoirs 53 are sealed by the flexible sealing sections 58 so as to obtain the compliance.

The head case 43 is a hollow box member bonded to the upper side of the compliance substrate 42 (opposite side to the protection substrate 41). Inside the head case 43, there is provided the insertion space 59 penetrating therethrough in the height direction; the lower end of the insertion space 59 communicates with the arrangement space 54 of the protection substrate 41, and the upper end thereof communicates with the connection space 30 of the connection member 15. With this, the flexible cable 29 connects the connection substrate 17 with the leading electrode which is electrically connected to the piezoelectric element 40 via the connection space 30, the insertion space 59, and the arrangement space 54.

Further inside the head case 43, case flow paths 60 are formed penetrating therethrough in the height direction. The case flow paths 60 are flow paths to supply ink from the connection member 15 to the reservoirs 53; in each case flow path 60, the upper end communicates with the connection flow path 31 while the lower end communicates with the ink introduction port 57. Of the lower surface of the head case 43, at the portions corresponding to the sealing sections 58, there are provided sealing spaces which are so sized as not to interfere with flexible deformation of the sealing film 55.

Ink from the ink cartridge 7 is introduced into the case flow path 60 of the recording head main body 16 through the introduction needle flow path 22, the holder flow path 27, and the connection flow path 31. The ink having been introduced into the case flow path 60 is supplied to the pressure chamber 46 via the reservoir 53 and the ink supply path 47. While the ink being inside the pressure chamber 46, if an electric signal from the control unit is supplied to the piezoelectric element 40 via the connection substrate 17, the flexible cable 29, and the leading electrode, the piezoelectric element 40 is driven to cause a pressure change in the ink inside the pressure chamber 46. The ink is ejected through the nozzle 48 by making use of this pressure change.

Figure 4:
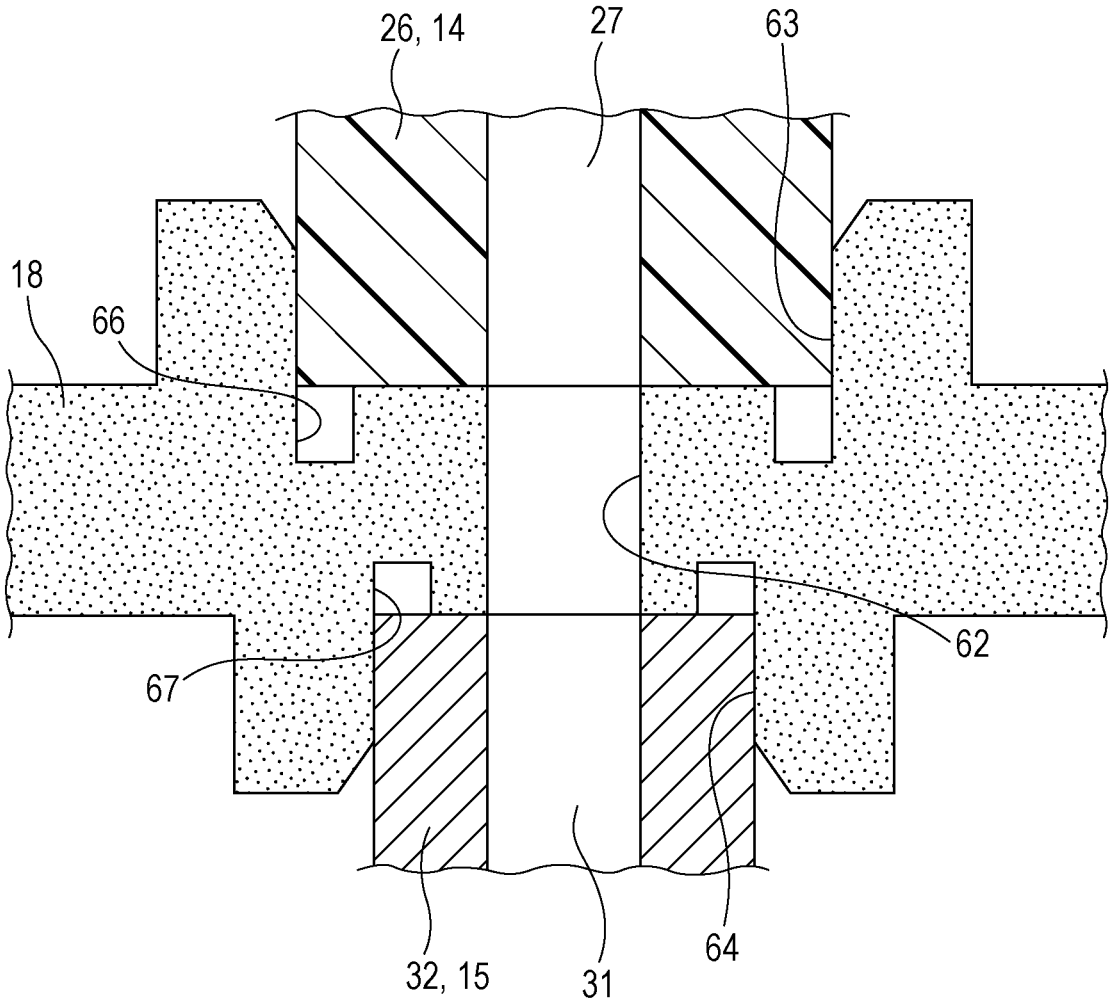
FIG. 4 is an enlarged view of a region IV in FIG. 2.

Next, the structure of a section of the seal member 18 configured to connect the holder flow path 27 with the connection flow path 31 will be described in detail with reference to FIG. 4. The seal member 18 includes, at the section where the holder flow path 27 and the connection flow path 31 are to be connected with each other, a communication hole 62 which makes the holder flow path 27 communicate with the connection flow path 31 in a state of the seal member 18 being nipped between the holder projection 26 and the connection projection 32 (in a state of being partially deformed in an elastic manner and pressed down to deform by a pressing force applied from both the projections). The communication hole 62 is formed so that the diameter of the opening at the upper surface side is equal in size to the diameter of the holder flow path 27 at its lower end while the diameter of the opening at the lower surface side is approximately equal in size to the diameter of the connection flow path 31 at its upper end, in a state in which the opening circumferential edge portion of the communication hole 62 is pressed down to deform between the holder projection 26 and the connection projection 32. In other words, the seal member 18 is formed so that a step between the inner surface of the holder flow path 27 and the inner surface of the communication hole 62 and a step between the inner surface of the communication hole 62 and the inner surface of the connection flow path 31 are unlikely to be produced in a state in which the holder flow path 27 communicates with the connection flow path 31. In order to realize such structure, the openings at the upper and lower surface sides of the communication hole 62 are so formed as to be larger in size than the lower end opening of the holder flow path 27 and the upper end opening of the connection flow path 31 in a state of the seal member 18 before being pressed down to deform between the holder projection 26 and the connection projection 32.

Outside the communication hole 62, there is provided a holder-side fitting recess 63 (equivalent to a first recess of this invention), at a face on the holder 14 side, that fits onto the outer circumferential surface of the holder projection 26 to regulate a position (define a position) of the holder projection 26. To rephrase, the upper end of the communication hole 62 is open in the bottom of the holder-side fitting recess 63. Further, the leading end (lower end surface) of the holder projection 26 makes contact with the bottom of the holder-side fitting recess 63 and presses the contact portion. In this embodiment, the holder-side fitting recess 63 is an inside space of a portion which is erected in cylindrical form from the face on the holder 14 side, and the inside diameter of this inside space is so formed as to be approximately equal in size to the outside diameter of the holder projection 26. With this, when the holder 14 is connected with the seal member 18, the inner circumferential surface of the holder-side fitting recess 63 and the outer circumferential surface of the holder projection 26 fit to each other so that the relative positions thereof are defined. Moreover, in this embodiment, there is provided a tapered section in which an opening edge of the holder-side fitting recess 63 is downwardly-inclined toward the inner side. To rephrase, an opening portion of the holder-side fitting recess 63 is gradually expanded in diameter toward the upper-side opening. Accordingly, in the case where the holder-side fitting recess 63 and the holder projection 26 are to be fitted to each other, it is easy to fit them to each other (define the positioning thereof).

Likewise, outside the communication hole 62, there is provided a connection member-side fitting recess 64 (equivalent to a first recess of this invention) at a face on the connection member 15 side that fits onto the outer circumferential surface of the connection projection 32 to regulate a position (define a position) of the connection projection 32. To rephrase, the lower end of the communication hole 62 is open in the bottom of the connection member-side fitting recess 64. Further, the leading end (upper end surface) of the connection projection 32 makes contact with the bottom of the connection member-side fitting recess 64 and presses the contact portion. In this embodiment, the connection member-side fitting recess 64 is an inside space of a portion which is erected in cylindrical form from the face on the connection member 15 side, and the inside diameter of this inside space is so formed as to be approximately equal in size to the outside diameter of the connection projection 32. With this, when the connection member 15 is connected with the seal member 18, the inner circumferential surface of the connection member-side fitting recess 64 and the outer circumferential surface of the connection projection 32 fit to each other so that the relative positions thereof are defined. Moreover, in this embodiment, there is provided a tapered section in which an opening edge of the connection member-side fitting recess 64 is upwardly-inclined toward the inner side. To rephrase, an opening portion of the connection member-side fitting recess 64 is gradually expanded in diameter toward the lower-side opening. Accordingly, in the case where the connection member-side fitting recess 64 and the connection projection 32 are to be fitted to each other, it is easy to fit them to each other (define the positioning thereof).

Then, the holder flow path 27 and the connection flow path 31 can be made to communicate with each other via the communication hole 62 by causing the leading end of the holder projection 26 to make contact with the bottom of the holder-side fitting recess 63, the leading end of the connection projection 32 to make contact with the bottom of the connection member-side fitting recess 64, and the holder projection 26 and connection projection 32 to nip and press the seal member 18.

Here, in the bottom of the holder-side fitting recess 63, there is provided a holder-side recessed groove 66 that is formed being hollowed in recess form toward the opposite side with respect to the holder 14 and extended along the inner circumferential surface of the holder-side fitting recess 63 in circular form surrounding the opening of the communication hole 62. Therefore, the portion on the inner side with respect to the holder-side recessed groove 66 (communication hole 62 side) is formed in a cylindrical shape. The leading end of the holder projection 26 makes contact with a leading end surface of this cylindrically-shaped portion. In addition, in the bottom of the connection member-side fitting recess 64, there is provided a connection member-side recessed groove 67 that is formed being hollowed in recess form toward the opposite side with respect to the connection member 15 and extended along the inner circumferential surface of the connection member-side fitting recess 64 in circular form surrounding the opening of the communication hole 62. Therefore, the portion on the inner side with respect to the connection member-side recessed groove 67 is formed in a cylindrical shape. The leading end of the connection projection 32 makes contact with a leading end surface of this cylindrically-shaped portion. Accordingly, in the case where the seal member 18 is nipped and pressed by the holder projection 26 and the connection projection 32, some volume of the thick portion of the seal member 18 which is in contact with the holder projection 26 can be removed to the holder-side recessed groove 66, and some volume of the thick portion of the seal member 18 which is in contact with the connection projection 32 can be also removed to the connection member-side recessed groove 67. Through this, the reaction force from the seal member 18 can be reduced in the above-mentioned portions. Note that the holder-side recessed groove 66 and the connection member-side recessed groove 67 are equivalent to a second recess of this invention.

As described above, in the recording head 3 of this invention, because the holder-side recessed groove 66 and the communication member-side recessed groove 67 allow the deformation of the seal member 18 at a communication portion between the holder flow path 27 and the connection flow path 31, the reactive force of the seal member 18 can be reduced. This makes it possible to suppress the recording head 3 from deforming itself due to the reactive force and consequently suppress the occurrence of an ink droplet ejection (discharge) failure. In addition, because the position of the holder projection 26 and the position of the connection projection 32 can be respectively regulated by the holder-side fitting recess 63 and the connection member-side fitting recess 64, even if the seal member 18 with a low coefficient of elasticity is used, the deviation in position is suppressed so that the holder flow path 27 and the connection flow path 31 can be made to surely communicate with each other. As a result, for example, a hyperelastic material such as rubber can be used as the seal member 18 so as to further reduce the reactive force of the seal member 18. Furthermore, because the holder-side fitting recess 63 and the connection member-side fitting recess 64 are respectively formed at the inner side of a portion which is erected from a face (upper face) on the holder projection 26 side in a direction to the same side and at the inner side of a portion which is erected from a face (lower face) on the connection projection 32 side in a direction to the same side, the outer walls constructing the inner circumferential surface of the holder-side fitting recess 63 and the inner circumferential surface of the connection member-side fitting recess 64 can be made thinner to be bent with ease. This makes it easier to fit and connect the holder-side fitting recess 63 to the leading end portion of the holder projection 26 and to fit and connect the connection member-side fitting recess 64 to the leading end portion of the connection projection 32.

Figure 5:
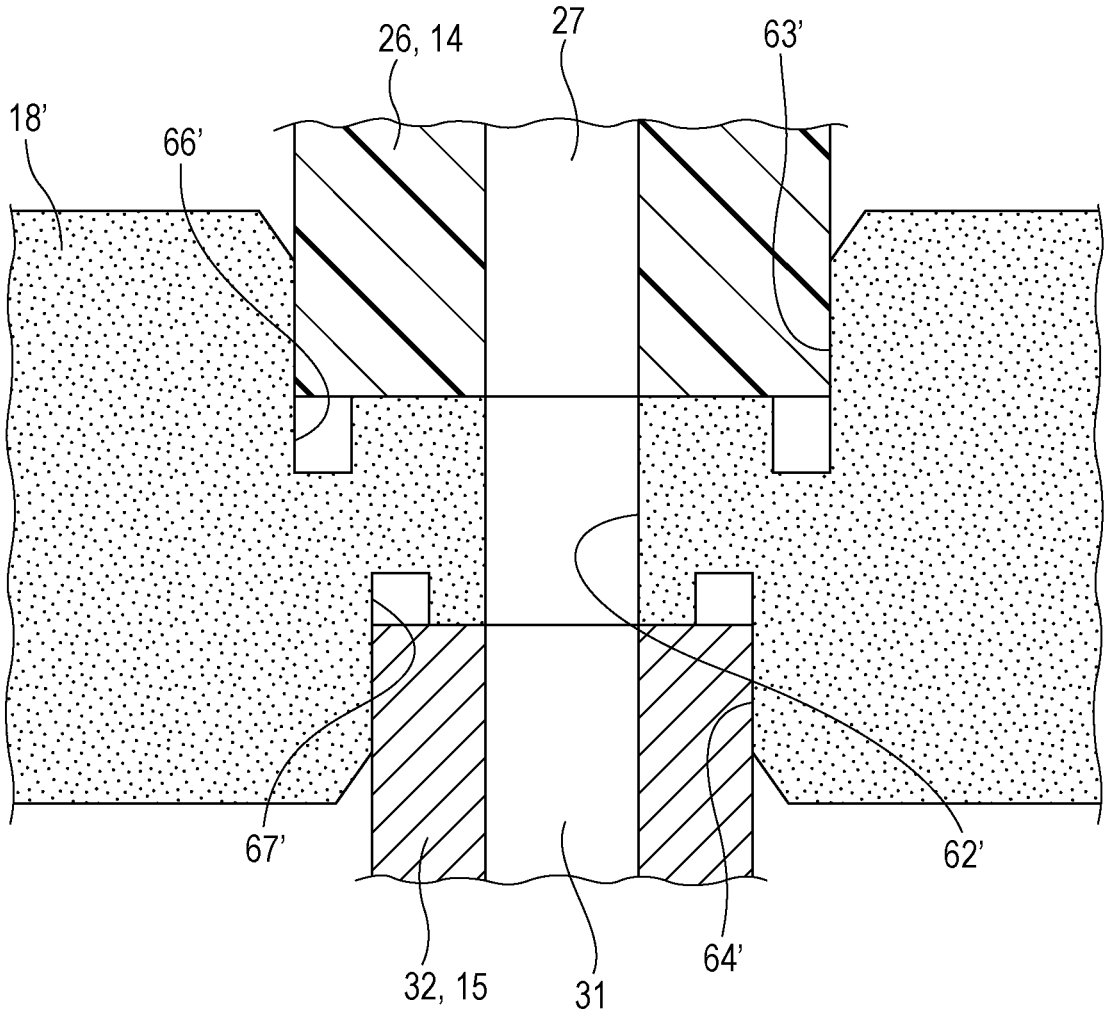
FIG. 5 is a descriptive view of a seal member according to a second embodiment.

In the above-described embodiment, although the holder-side fitting recess and connection member-side fitting recess of the seal member are formed at the inside of cylindrically-shaped portions, the invention is not limited thereto. For example, in a second embodiment as illustrated in FIG. 5, a holder-side fitting recess 63' and a connection member-side fitting recess 64' of a seal member 18' are formed in a recess shape that is hollowed from a surface of the seal member 18'. In other words, the holder-side fitting recess 63' is formed in a recess shape which is hollowed from a face on the holder 14 side halfway to the opposite side, and the inside diameter thereof is formed to be approximately equal in size to the outside diameter of the holder projection. Then, the upper end of a communication hole 62' is open in the bottom of the holder-side fitting recess 63', and in the periphery of the upper end opening, a holder-side recessed groove 66' is formed. Further, a connection member-side fitting recess 64' is formed in a recess shape which is hollowed from a face on the connection member 15 side halfway to the opposite side, and the inside diameter thereof is formed to be approximately equal to the outside diameter of the connection projection. Then, the lower end of the communication hole 62' is open in the bottom of the connection member-side fitting recess 64', and in the periphery of the lower end opening, a connection member-side recessed groove 67' is formed. Furthermore, in the seal member 18' of this embodiment, plate thicknesses of the portions other than the holder-side fitting recess 63' and connection member-side fitting recess 64' are made thicker compared with the seal member 18 of the aforementioned embodiment. With this, of the seal member 18', rigidity of the portions other than the holder-side fitting recess 63' and connection member-side fitting recess 64' can be enhanced, thereby making it possible to suppress the deviation in position due to the seal member 18' being bent. Descriptions of other constituent elements will be omitted herein because they are the same as those of the aforementioned embodiment.

In the above embodiments, although the configuration in which a seal member is used in a connection section of the holder flow path of the holder and the connection flow path of the connection member is exemplified, the invention is not limited thereto. That is, the invention can be applied to any configuration in which a seal member causes two flow paths respectively provided in different members to communicate with each other. Further, in the above-described embodiments, although the connection projection is formed having a smaller diameter than that of the holder projection, the invention is not limited thereto. For example, the connection projection may be formed having a larger diameter than that of the holder projection, or the connection projection and the holder projection may be formed having substantially the same diameter. In addition, in the embodiments described above, although both the holder-side recessed groove and the connection member-side recessed groove are provided, the invention is not limited thereto. It is sufficient that at least one of the holder-side recessed groove and the connection member-side recessed groove is provided. Moreover, the shapes of the holder-side recessed groove and the connection member-side recessed groove are not limited to those described in the above embodiments. For example, the grooves may be formed in a trapezoidal shape or a V shape in which the opening width is gradually expanded toward the opening portion. That is to say, any shape can be employed as long as a pressed portion of the seal member can be removed in the case where the seal member is pressed by the connection projection and the holder projection.

In the embodiments described above, although an ink jet recording head that is mounted in an ink jet printer is exemplified, the invention can be also applied to devices that eject liquids other than ink. For example, the invention can be applied to coloring material ejecting heads used in the manufacture of color filters of liquid crystal displays or the like, electrode material ejecting heads used in the formation of electrodes of organic EL (electroluminescence) displays, FEDs (surface emitting displays) or the like, bioorganic matter ejecting heads used in the manufacture of biochips (biochemical elements), and so on.

What is claimed is:

1. A liquid ejecting head comprising:

a first head constituent member equipped with a first flow path;

a second head constituent member equipped with a second flow path; and a seal member that is disposed between the first and second head constituent members, wherein at least one of the first and second head constituent members includes a projection that sticks out toward the seal member, and the seal member includes a recess that fits onto an outer circumferential surface of the projection and also fits to a leading end portion of the projection, and a groove that is hollowed in a surface on a side that is in contact with the leading end portion of the recess.

2. The liquid ejecting head according to claim 1, wherein the seal member is formed of an elastic material.

3. A liquid ejecting apparatus comprising:

the liquid ejecting head according to claim 2.

4. The liquid ejecting head according to claim 1, wherein the recess is formed at an inner side of a cylindrical portion which is erected from a face on the projection side in a direction to the same side.

5. A liquid ejecting apparatus comprising:

the liquid ejecting head according to claim 4.

6. A liquid ejecting apparatus comprising:

the liquid ejecting head according to claim 1.

* * * * *